United States Patent [19]

Escales et al.

[11] 4,098,158

[45] Jul. 4, 1978

[54] METHOD OF AND APPARATUS FOR SEVERING STRIPS OF MATERIAL

[75] Inventors: Eberhard Escales, Münich; August Hell, Feldkirchen, both of Fed. Rep. of Germany

[73] Assignee: AGFA-Gevaert AG, Leverkusen, Fed. Rep. of Germany

[21] Appl. No.: 769,837

[22] Filed: Feb. 17, 1977

[30] Foreign Application Priority Data

Feb. 20, 1976 [DE] Fed. Rep. of Germany ..... 2606814

[51] Int. Cl.[2] ..... B26D 7/06; B26D 5/38

[52] U.S. Cl. ..... 83/27; 83/371

[58] Field of Search ..... 83/371, 27

[56] References Cited

U.S. PATENT DOCUMENTS

| | | | |
|---|---|---|---|
| 3,793,915 | 2/1974 | Hujer | 83/371 X |
| 3,822,624 | 7/1974 | Shoji et al. | 83/371 X |
| 4,034,973 | 7/1977 | Hams | 83/371 X |

*Primary Examiner*—Willie G. Abercrombie
*Attorney, Agent, or Firm*—Michael J. Striker

[57] ABSTRACT

A strip is composed of a plurality of successive groups of successive strip sections. The strip is provided with end-of-group indications coordinated with the ends of the respective groups of strip sections. The strip is transported backwards along a predetermined path so that each end-of-group marking precedes the first section of the respective group of sections. A detector located at a predetermined position along the transport path detects the end-of-group markings and generates corresponding end-of-order signals. The end-of-order signals are applied to a storage device. In response to each end-of-order signal, the storage device activates a separating device for separating one order from the next. However, the activation occurs only after the elapse of a time delay compensating for the backward transport of the strip. Thus, if prior to such backward transport the strip is transported forward for processing and during such forward transport fed to a take-up roller, the possibility of performing the detecting and separating operations during backward transport of the strip makes unnecessary unrolling and rerolling of the strip for a renewed forward transport.

5 Claims, 1 Drawing Figure

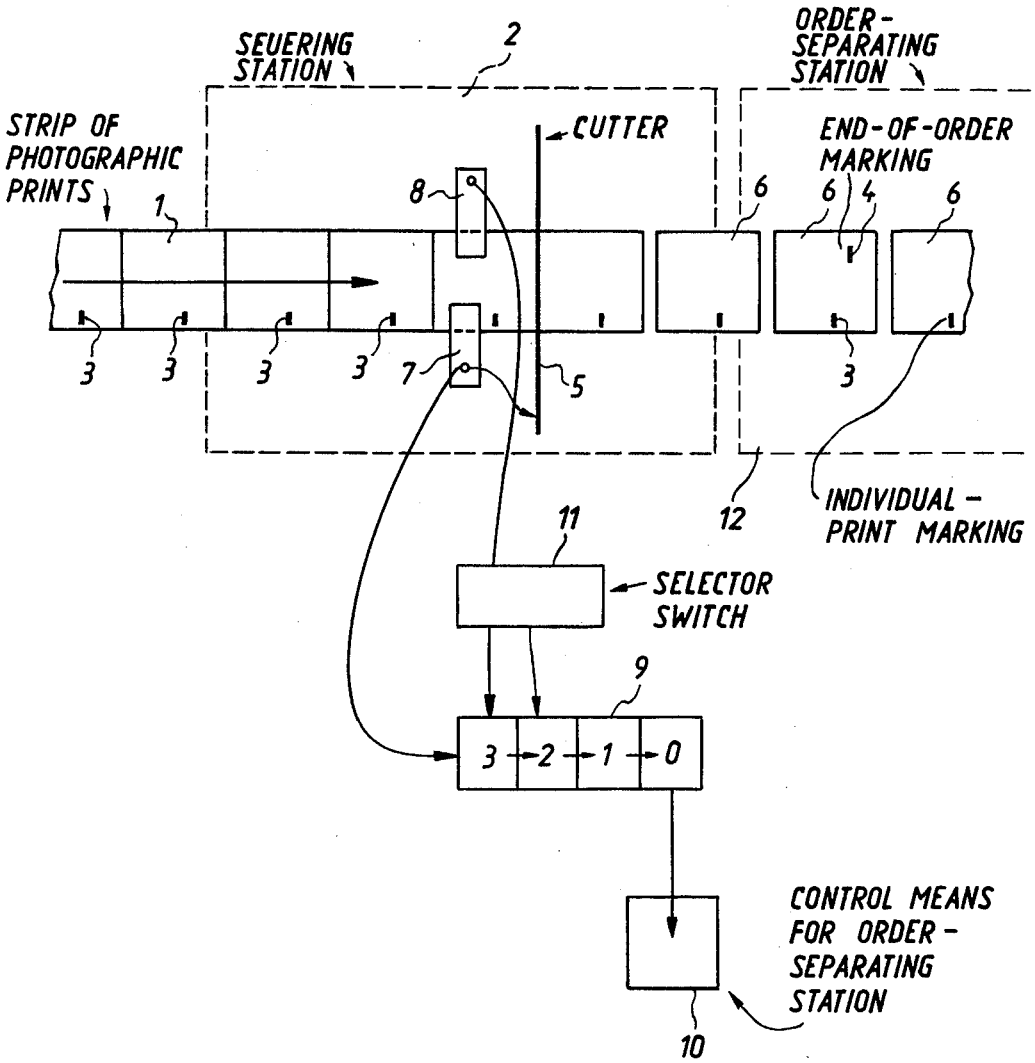
SEUERING STATION
2
ORDER-SEPARATING STATION
STRIP OF PHOTOGRAPHIC PRINTS
CUTTER
END-OF-ORDER MARKING
1
8
6
6
4
6
3
3
3
3
7
5
3
12
INDIVIDUAL-PRINT MARKING
11
SELECTOR SWITCH
9
3
2
1
0
CONTROL MEANS FOR ORDER-SEPARATING STATION
10

METHOD OF AND APPARATUS FOR SEVERING STRIPS OF MATERIAL

BACKGROUND OF THE INVENTION

The invention relates to the processing of strips of material, particularly strips of photographic prints arranged in successive groups, each group constituting a customer order. Conventionally, such strips are provided with end-of-order markings near the end of each order coordinated with the last print in the order, and with individual-print markings coordinated with the individual prints. These markings are used to properly synchronize severing and sorting operations.

In automatic photographic printers, during the printing operation, the back side of the strip of printing paper is provided with end-of-order markings and individual-print markings such as just referred to. The individual-print markings are detected at a severing station, and in coordination with such detection the individual prints are severed one from the next. The end-of-order markings are detected and are used to control the sorting of the different customer orders. Alternatively, the end-of-order markings may be used to sever the last print of one order from the first print of the next, when the prints are not individually severed. The sorting operation may involve transport of the different orders at spaced time intervals to a station where the prints and the negatives are inserted into envelopes, or other such transport operations.

Usually, the aforementioned markings are not located in exact coincidence with the portion of the strip upon which the operations synchronized by the markings are actually performed. For example, the individual-print markings are usually not located coincident with the cut lines to be formed at the severing station, but instead are located upstream of the respective cut lines, so that these markings will be detected at a location upstream of the actual severing station. The same generally applies to the end-of-order markings which are detected by a detector located upstream of the actual sorter for the different orders.

A problem with known processing techniques involving these markings is that their locations relative to ends of orders and the individual prints necessitate forward transport of the strip through the severing and sorting stations, in correspondence to the forward transport of the strip through the exposure and developing stations of the printer. However, it is usually the case that, during the forward transport of the strip through the printer, the strip is forward-transported through a monitoring station located downstream of the printer, for automatic and/or subjective checking of the quality of the prints. The forward-transported strip is then fed to a take-up roller, or the like, and rolled up. Consequently, the accessible end of the rolled-up strip is the trailing end thereof, making it impossible to directly feed the strip off the take-up roll for forward transport through the severing and sorting stations. Instead, it is necessary to unroll the strip from the take-up roller, and then reroll it, for example, on a different take-up roller, so that the accessible end of the rerolled strip will be its leading end. The leading end can then be pulled off the take-up roller and fed to the severing and sorting stations for forward transport of the strip therethrough. This constitutes an inconvenient intermediate operation.

SUMMARY OF THE INVENTION

It is a general object of the invention to provide an operative way of performing the requisite detection and severing and/or sorting operations at the severing and/or sorting stations during backward transport of the strip of material.

This can be accomplished, according to one advantageous concept of the invention, by transporting the strip backwards along a predetermined path past detectors for the end-of-order and individual-print markings and applying the signals generated by the detectors to a storage means which activates the severing and/or sorting means of the respective stations in response to such signals, but only after the elapse of a time delay compensating for the backward transport of the strip.

An important advantage of the invention is that, after the forward-transported strip has passed through the monitoring station and been rolled up onto a take-up device, the accessible trailing end of the strip can be pulled off the take-up device and immediately fed to the severing and/or sorting stations with no intermediate unrolling-rerolling operations, and accordingly no unnecessary loss of time.

Transporting the strip of photographic prints through the severing station in the direction opposite to its transport through the printer can also be of advantage for a further reason. After the printing operation is performed, it is common to pass the strip of negatives through a severing station in backward direction. In modern post-printing processing machines, however, the strip of negatives and the strip of prints are usually severed into individual negatives and prints at the same time, with the severed negatives and severed prints of each order being fed into a common envelope, or the like, for delivery to the customer. The possibility of severing both the individual negatives and the individual prints during transport of the strip of negatives and the strip of prints in corresponding directions is accordingly of considerable importance.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE schematically depicts one embodiment of the present invention.

DESCRIPTION OF THE PREFERRED EMBODIMENTS

Numeral 1 denotes a strip of exposed and developed photographic print paper consisting of successive individual prints. The individual prints are denoted by numeral 6. Each print 6 is provided on its back side with an individual-print marking 3. The last print 6 in each customer order is provided with an end-of-order marking 4. In the FIGURE, the strip 1 is being transported, in the direction of the arrow, in backward direction, so that the end-of-order marking 4 of each customer order precedes all but the last print in the respective customer order.

The backward-transported strip 1 is fed through a severing station 2 and an order-separating station 12.

Severing station 2 is provided with a (schematically depicted) cutter 5 which severs the individual prints 6 from the strip 1. The order-separating station 12 is provided with suitable conventional means (not illustrated) for separating the group of prints constituting one customer order from the group of prints constituting the next customer order; this may involve means for neatly stacking the prints of one customer order and then transporting the stack to an envelope, followed by neat stacking of the prints of the next customer order, or other conventional order-separating procedures. Numeral 10 denotes the control means for the order-separating station. Receipt by control means 10 of a control signal causes an order-separating operation to be performed.

Provided at severing station 2 is a detector 7 for the individual-print markings 3. Each time detector 7 senses a marking 3 it applies an activating signal to the cutter 5, which severs one print 6 from the strip 1 at a proper cut line. The detector 7 is located upstream of the cutter 5.

Severing station 2 is additionally provided with a detector 8 for the end-of-order markings 4. Each time detector 8 senses an end-of-order marking, it generates a corresponding end-of-order signal. Advantageously, the detectors 7 and 8 are adjustably mounted, for fine adjustment and to make possible processing of print strips whose markings may be differently located.

The end-of-order signal generated by detector 8 is utilized to activate the control means 10 for the order-separating station 12. However, because of the backward transport of the strip 1 through the severing and separating stations, it is not possible to directly apply the end-of-order signal to the control means 10. In the illustrated embodiment, the end-of-order signal from detector 8 is applied to the information-signal input of one of the stages of a shift register 9. For the sake of simplicity, a four-stage shift register is shown; however, it is to be understood that this is merely schematic. The end-of-order signal is applied to the information-signal input of either the third-from-last or second-from-last shift-register stage, through the intermediary of a selector switch 11, which makes possible preselection of the time delay which the shift register 9 is to introduce.

The individual-print signal generated by detector 7 is applied to the shift-signal input of shift register 9.

The last shift-register stage (designated 0) has an information-signal output connected to the input of the control means 10 for the order-separating station.

The detectors 7 and 8 are so located that when detector 8 senses an end-of-order marking 4, detector 7 will be sensing an individual-print marking 3. Accordingly, an end-of-order signal will be applied to the information-signal input of the selected shift-register stage, and will be registered therein because of the concurrent application of an individual-print signal to the shift-signal input of shift register 9. The individual-print marking 3 of the next print causes detector 7 to apply a further individual-print signal to the shift-signal input of the shift register. As a result, the end-of-order signal will be shifted to the next-following shift register stage. After a sufficient number of individual-print signals have been applied to the shift register, the end-of-order signal will appear at the information-signal output of the last shift-register stage and be applied to the control means 10, initiating an order-separating operation.

Instead of a shift register 9, use could be made of other storage and/or time-delay devices, whether electronic, mechanical, magnetic or optical, in which the magnitude of the introduced time delay is determined by the number of individual-print signals applied to the device. Also, the illustrated embodiment contemplates that the number of prints is the same for each successive order. However, the inventive concept also contemplates more complicated storage techniques suitable for cases where the number of prints in each order may change from one order to the next.

It will be understood that each of the elements described above, or two or more together, may also find a useful application in other types of circuits and constructions differing from the types described above.

While the invention has been illustrated and described as embodied in the severing of individual prints from a strip of photographic prints and the separating of the groups of prints constituting the customer orders, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a method of processing a strip composed of a plurality of successive groups of successive strip sections each bearing a respective photographic image, each group of strip sections constituting one order, the strip being provided with end-of-order markings each coordinated with the last image of the respective order and located near the end of the respective order, in combination, the steps of transporting the strip backwards along a predetermined path so that each end-of-order marking precedes the first image of the respective order; using a detector located at a predetermined position along said path for detecting the end-of-order markings and generating corresponding end-of-order signals; in response to each generated end-of-order signal generating a corresponding activating signal, by applying the end-of-order signal to a time-delay device, setting the time-delay device for a time delay compensating for the backward transport of the strip and utilizing the time-delayed end-of-order signal as the activating signal; and applying the activating signals to a separating means to cause the latter to separate one order from the next.

2. The method defined in claim 1; further including the step of first transporting the strip forwards prior to the step of transporting the strip backwards, and during the forward transport processing the strip and feeding the strip to a take-up roller and rolling the strip thereonto, the step of transporting the strip backwards comprising pulling the strip off the take-up roller and transporting the strip backwards so that each end-of-order marking precedes the first image of the respective order, whereby the detection of the end-of-order markings and the separating of the orders in response thereto can be performed without preliminary unrolling and rerolling of the strip for a renewed forward transport.

3. In an apparatus for processing a strip composed of a plurality of successive groups of successive strip sections, each strip section bearing at least one respective photographic image, each group of strip sections constituting one customer order, each strip section being provided with an individual-section marking, each group of strip sections being provided with an end-of-order marking coordinated with the last image of the respective order and located near the end of the respective order, in combination, means for transporting the strip backwards along a predetermined path so that each end-of-order marking is at the leading end of the respective customer order; a severing station arranged along said path including severing means operative when activated for severing an individual strip section from the strip; an order-separating station located downstream of the severing station for receiving severed individual strip sections and including order-separating means operative when activated for performing an order-separating operation upon a group of strip sections constituting one customer order; first detecting means located along the transport path and operative for detecting each individual-section marking, generating a corresponding individual-section signal and activating the severing means; second detecting means located along the transport path and operative for detecting each end-of-order marking and generating a corresponding end-of-order signal; and storage means receiving the end-of-order signals and the individual-section signals and operative for activating the order-separating means in response to receipt of an end-of-order signal followed by receipt of a plurality of individual-section signals, the number of individual-section signals in said plurality of individual-section signals being such as to introduce into the activation of the order-separating means a time delay compensating for the backwards transport of the strip.

4. The apparatus defined in claim 3, said storage means comprising a shift register comprised of a plurality of shift-register stages, the shift register having an information-signal input connected to the second detecting means for receipt and registration of the end-of-order signals and a shift-signal input connected to the first detecting means for receipt of the individual-section signals and having an information-signal output for furnishing as the activating signals for the order-separating means the end-of-order signals shifted through the shift register.

5. The apparatus defined in claim 4, more than one of the shift-register stages having information-signal inputs and including means for alternatively connecting to the second detecting means the information-signal inputs of different ones of the shift-register stages to establish different respective time delays.

* * * * *